US005893775A

United States Patent [19]

Annokkee et al.

[11] Patent Number: 5,893,775

[45] Date of Patent: Apr. 13, 1999

[54] ELECTRICAL CONNECTOR FOR A FLAT FLEXIBLE CONDUCTOR

[75] Inventors: Willem Robert Annokkee, Rosmalen; Dolf Campschroer, Wijchen; Walter Randolph Verbeet, Vught, all of Netherlands

[73] Assignee: The Whitaker Corporation, Wilmington, Del.

[21] Appl. No.: 08/979,027

[22] Filed: Nov. 26, 1997

[30] Foreign Application Priority Data

Dec. 20, 1996 [EP] European Pat. Off. ..... 96120700.8

[51] Int. Cl.[6] ..... H01R 9/07

[52] U.S. Cl. ..... 439/495

[58] Field of Search ..... 439/492, 495, 439/496, 67, 77

[56] References Cited

U.S. PATENT DOCUMENTS

| | | | |
|---|---|---|---|
| 4,734,053 | 3/1988 | Imai | 439/329 |
| 4,900,268 | 2/1990 | Kunishi | 439/493 |
| 5,106,311 | 4/1992 | Yodogawa et al. | 439/77 |
| 5,549,485 | 8/1996 | Chishima et al. | 439/67 |

FOREIGN PATENT DOCUMENTS

| | | |
|---|---|---|
| 0 540 260-A2 | 5/1993 | European Pat. Off. . |
| 0 280 449-A2 | 7/1998 | European Pat. Off. . |
| 40 41 093-C1 | 4/1992 | Germany . |

*Primary Examiner*—Neil Abrams
*Assistant Examiner*—Barry M. L. Standig

[57] ABSTRACT

An electrical connector having a housing to receive a flexible film conductor, wherein a plurality of contacts having a first fixed end and a second freely movable end is arranged inside the housing and where a pressing block is introduced an opening in the housing where the flexible film conductor is to be received to press the conductor against the second freely movable end thereby generating a spring force in the contact by stretching a spring portion thereof.

8 Claims, 4 Drawing Sheets

ELECTRICAL CONNECTOR FOR A FLAT FLEXIBLE CONDUCTOR

BACKGROUND OF THE INVENTION

1. Field of the Invention

The invention relates to an electrical connector particularly suited for the contacting of a flat foil conductor.

2. Description of the Prior Art

Flat foil conductors are used for connecting a multiplicity of conductors arranged in parallel to form electrical or electronic components. Known application examples are encountered in the case of printing cartridges in ink-jet printers, the display of pocket calculators, or in mobile phones. The advantage of flat foil conductor connectors is that a large number of conductors can be installed in a very confined space. Owing to the confined conditions, the installation of the connector arrangement is often difficult, or at least not easy, to automate.

SUMMARY OF THE INVENTION

It is the object of the invention to specify an electrical connector for the contacting of a flat foil conductor which can be easily assembled.

This object is achieved by an electrical connector for the contacting of a flat foil conductor with a multiplicity of conductors. The connector comprises an insulative housing with an upper side; a plurality of contacts arranged in the housing; each contact has a first end fixed relative the housing and a freely movable second end exposed in an opening for receiving the flat foil conductor in the upper side of the housing in the opening and arranged in such a way that the conductors can be contacted in the opening; the contacts have between the fixed first end and the freely movable second end a spring region so that the freely movable second end can be moved in comparison with the fixed first end in the longitudinal direction of the contacts and a pressing block introduceable into the opening in such a way that the conductors of the flat foil conductor would be pressed by the pressing block against the respective movable second ends of the contacts and against the spring force of the contacts.

It is of advantage that the assembly of the connector can easily be automated. This is achieved by the fact that a pressing block can be easily introduced into the opening in the housing. The electrical connector may be mounted onto a flat underlying surface, such as a printed circuit board for example where all the movements necessary for installation and assembly can be performed in the same direction which could advantageously be perpendicular with respect to the underlying surface.

It is also of advantage that the electrical connector can withstand high mechanical loading. This is achieved by the housing having a double-T-shaped profile in a transitional region between the fastening region for the fixed first end and the opening for receiving the flat foil conductor.

DETAILED DESCRIPTION OF THE PREFERRED EMBODIMENT

Figure 1:
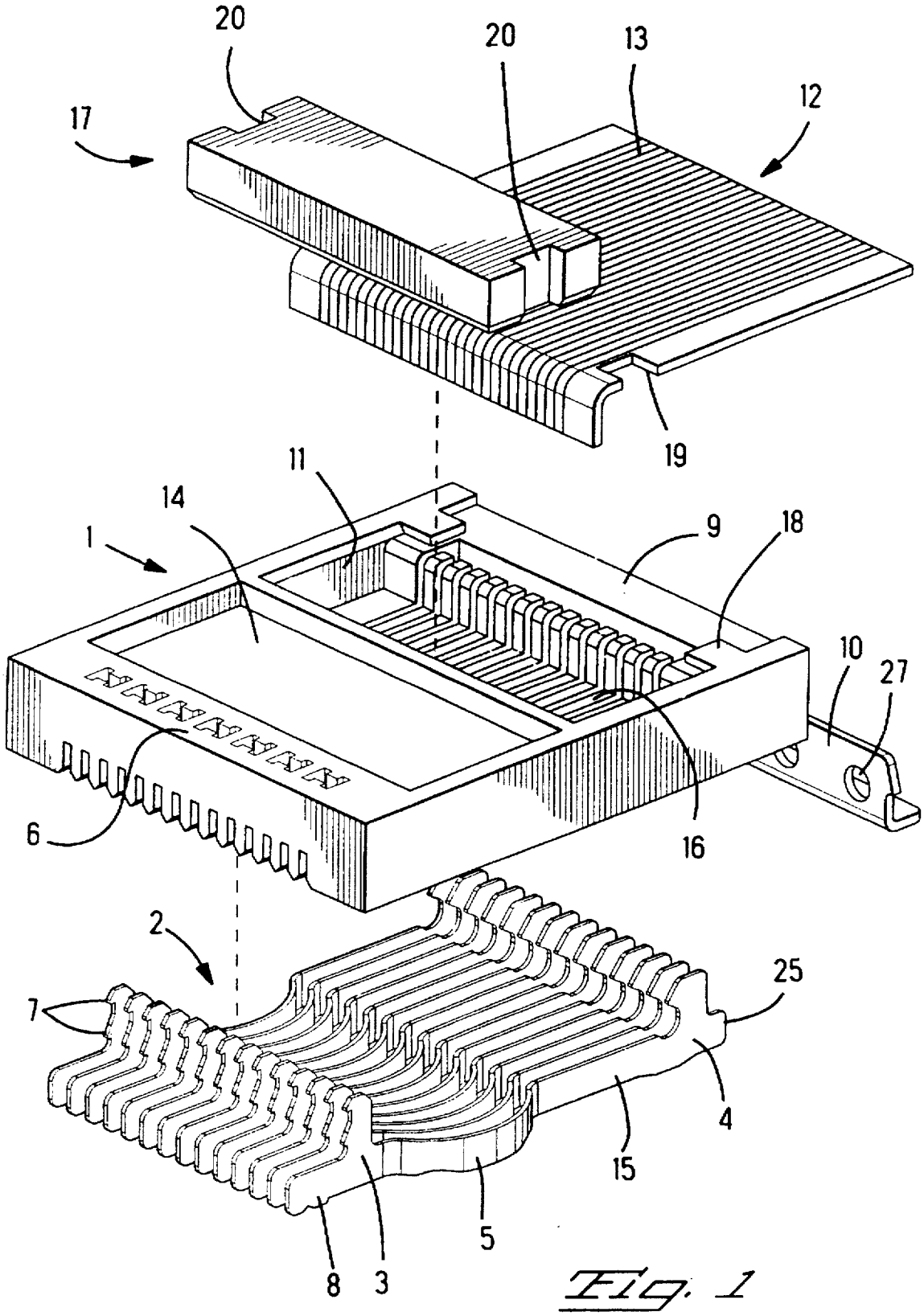
FIG. 1 shows a perspective view of an electrical connector for the contacting of a flat foil conductor according to the present invention in an exploded representation, prior to assembly.

Represented in FIG. 1 is a connector for the contacting of a flat foil conductor 12. The connector comprises a housing 1 with a substantially rectangular cross-section. A plurality of contacts 2 are arranged in the plastic part 1. Each contact 2 has a fixed first end 3 and a freely movable second end 4. The contacts 2 have a spring region 5 between the fixed first end 3 and the freely movable second end 4. The spring region 5 allows a resilient movement of the freely movable second end 4 in comparison with the fixed first end 3. The freely movable second end 4 can be moved in a longitudinal direction away from and towards the first fixed end 3 of the contact 2. In the untensioned state of the contact 2, the movable second end 4 is located closer to the fixed first end 3 than in the tensioned state of the contact 2, where the movable second end 4 is located farther away from the fixed first end 3.

In FIG. 1, the spring region 5 is shown bent in a C shape. However, multiple bending, for example an S-shaped bending, is also conceivable. The spring force which is produced by the movement of the freely movable second end 4 from the untensioned state to the tensioned state is achieved by the bent shape of the spring region 5. The spring force is produced here by the stretching of the pre-bent spring region 5. This is particularly advantageous if there is a small overall height available for the electrical connector arrangement, since the contact, and consequently the connector arrangement, requires less material and a smaller installation space with the same stability. The spring force could, however, also be produced by the compression of a pre-bent spring region.

When the contact 2 is inserted in the housing 1, the fixed first end 3 of the contact 2 is engaged in a fastening region 6 of the housing 1. In order to ensure a secure connection of the contact 2 with respect to the housing 1, the fixed first end 3 is provided with means 7 for interlocking therewith. Alongside the fixed first end 3, the contact 2 has a soldering tab 8. The contact can be connected by the soldering tab 8 to an underlying surface (not shown here), for example on a printed circuit board.

On the end opposite the fastening region 6, the plastic part 1 has a mounting region 9. In the mounting region 9, a mounting aid 10 is fitted, for example by stitching or by injection-moulded encapsulation into the housing 1. The housing 1 can be fastened by the mounting aid 10 onto the same underlying surface onto which the soldering tongues 8 are also fastened. When fastening the plastic part 1 on the underlying surface, it must be ensured that the arrangement is properly aligned. After the alignment on the underlying surface, on the one end, the mounting aid 10 is connected and on the other end the soldering tongues 8 are soldered on the underlying surface.

In FIG. 1 it can also be seen that the housing 1 has an opening 11 for receiving a flat foil conductor 12. The flat foil conductor 12 includes a multiplicity of conductors 13. The opening 11 for receiving the flat foil conductor 12 is arranged in an upper side of the housing 1 towards the mating end 9. As the opening 11 is upwardly facing, the flat foil conductor is insertable perpendicularly with respect to the longitudinal direction of the contacts 2. The housing 1 has between the opening 11 for receiving the flat foil conductor 12 and the fastening region 6 a transitional region 14, which has a double-T-shaped profile in cross-section (see cross-sectional view of FIG. 7) . The double-T-shaped profile achieves the effect that, with as little expenditure on material as possible, a high tension force exerted by the spring region can be absorbed. This is necessary when the flat foil conductor 12 is engaged in the opening 11 by the contacts 2. In the housing 1, the multiplicity of contacts 2 are arranged next to and parallel to one another. At least along a subregion 15 of the contacts 2, the contacts 2 are received in channels 16 formed in the housing 1 and running parallel next to one another to guide the freely movable second end 4.

The opening 11 for receiving the flat foil conductor 12 in the housing 1 is constructed for also receiving pressing block 17, shown over the opening 11. The pressing block 17 can be introduced into the opening 11 in the housing 1 perpendicularly. As a result of introducing the pressing block 17, the conductors 13 of the flat foil conductor 12 are pressed against the freely movable second ends 4 of the contacts 2 and the contacts 2 are tensioned, building up a spring force. The pressing block 17 substantially coincides with the width of the flat foil conductor 12 and has a cross-section which substantially coincides with the depth and width of the opening 11 in the housing 1.

In FIG. 1 it can be seen that both the pressing block 17 and the transitional region 14 are large surface areas, which are advantageous for automated assembly. Many assembly machines operate with vacuum devices, which can suck onto large surface areas and thus can move and assemble individual parts. In the case of the present invention, it is advantageous that all the movements during installation and during assembly can be performed in the same direction perpendicularly with respect to the running direction of the contacts, thereby easing assembly.

In FIG. 1 it can also be seen that the housing 1 has on both sides of mounting region 9 lugs 18, which should engage in corresponding clearances 19 in the flat foil conductor 12. The lugs 18 serve for positioning the flat foil conductor 12 during assembly and as a tension relief for the flat foil conductor 12 in the assembled state. The lugs 18 may have different dimensions. The clearances 19 of the flat foil conductor 12 may have the same different lengths and widths. This achieves the effect that the flat foil conductor 12 is not connected the wrong way round or to an incorrect plastic part.

The pressing block 17 has notches 20 on two opposite sides. The notches 20 are arranged on the sides which are not being used for transferring the force during contacting. The notches 20 make it easier to insert a tool, for example a screwdriver, if the connector arrangement is ever disassembled, and consequently make it possible for the pressing block 17 to be removed gently from the opening 11. In the assembled state, the pressing block 17 and the flat foil conductor 12 will be flush with the upper side of the plastic part 1. With corresponding dimensioning of the contacts 2 and the plastic part 1, a very low overall height can be maintained.

Figure 2:
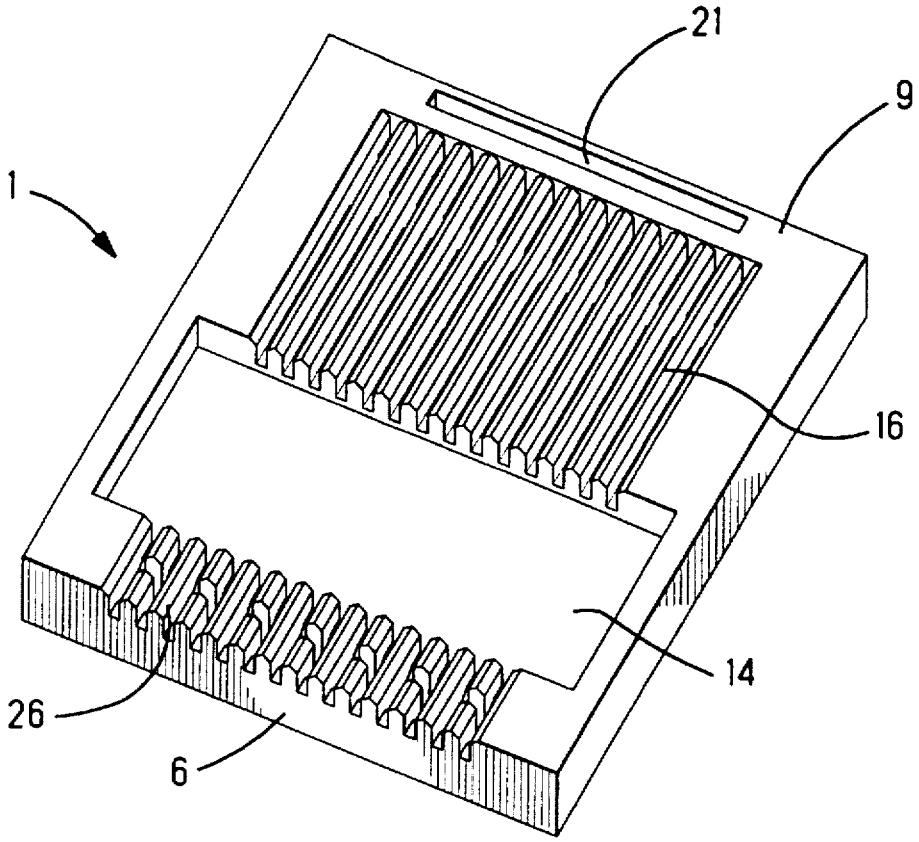
FIG. 2 shows a perspective view of the underside of the plastic part from FIG. 1.
Figure 3:
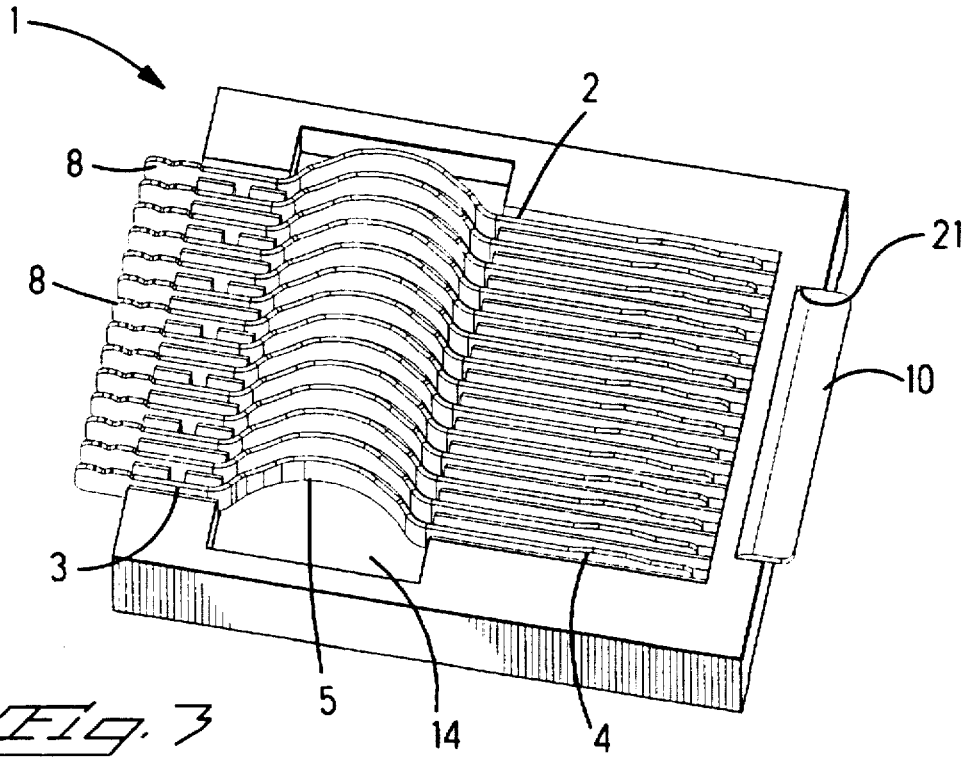
FIG. 3 shows a perspective view of the plastic part from FIG. 2, with inserted contacts.

In FIG. 2, the housing 1 is seen in a view of the underside. The underside of the fastening region 6 and of the mounting region 9 can be seen on the plastic part 1. In the mounting region 9, a slot 21 is shown for receiving the mounting aid 10. The parallel running channels 16 for receiving the subregion 15 of the contacts 2 can also be seen. As stated above, the channels 16 serve for guiding and electrically separating the contacts 2. The electrical contacts 2 are fitted into the channels 16 from the underside. In the mating region 9 where the freely movable second ends 4 of the contacts 2 are received, the channels 16 form a passage through from the underside to the upper side of the housing 1 by way of the interlocking means 7 described above. Further channels 26 are arranged in the fastening region 6. In the fastening region 6, the fixed first ends 3 of the contacts 2 are fastened on the plastic part 1. In the region between the channels 16 and the further channels 26, the underside of the transitional region 14 can be seen. In FIG. 3, the housing 1 from FIG. 2 is represented once again, with contacts 2 and the mounting aid 10 fitted thereto. It can be seen, that the spring region 5 of the contacts 2 is arranged in the transitional region 14.

Figure 4A:
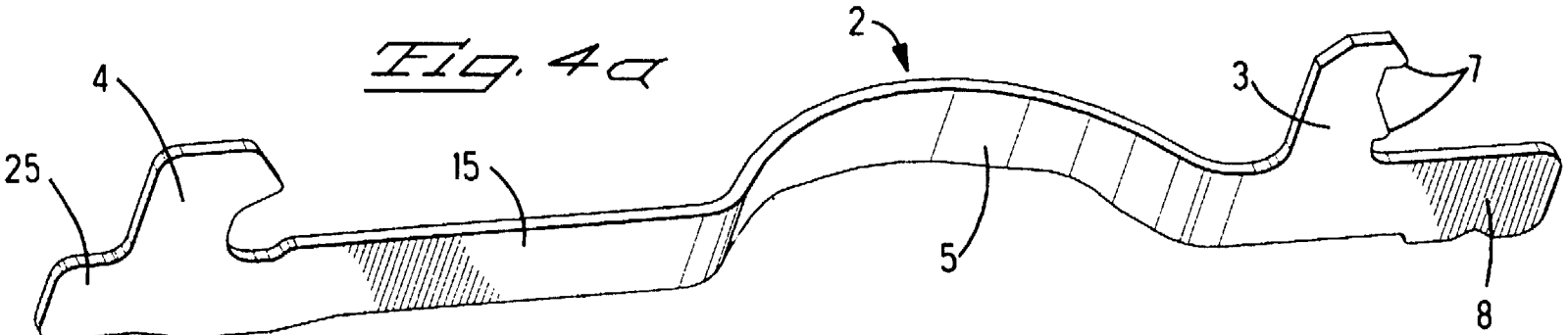
FIG. 4*a* shows a perspective view of a contact such as that used in the present invention.
Figure 4B:
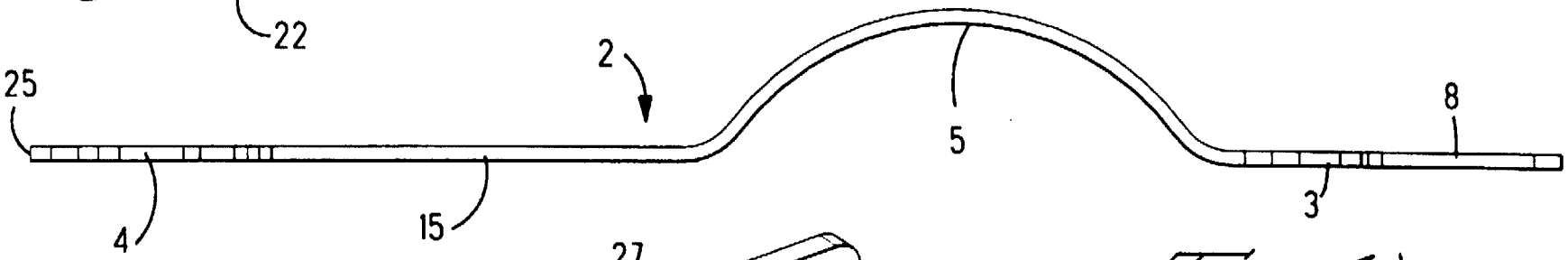
FIG. 4*b* shows a view of the contact from FIG. 4*a*.

In FIG. 4*a* and FIG. 4*b*, a single contact 2 is shown. As described above, the contact 2 comprises a fixed first end 3, a freely movable second end 4, a subregion 15 and a spring region 5. The means 7 for interlocking on the housing 1 are at the fixed first end 3. The fixed first end 3 also has a soldering tongue 8. The fixed first end 3 is fastened by the means 7 for interlocking in the fastening region of the plastic part 1 and fastened by the soldering tongues 8 on the underlying surface. The subregion 15 has a sliding skid 22. The sliding skid 22 permits a sliding movement on the underlying surface onto which the soldering tongue 8 has also been fastened. The sliding skid 22 assists the movements of the freely movable second end 4 and prevents movements perpendicularly with respect to the underlying surface. This prevents undesired flexure of the contact 2 when the pressing block 17 is fitted. The freely movable second end 4 also has an extension part 25. The extension part 25 runs beyond the freely movable second end 4 in an extension of the subregion 15. The extension part 25 is to be received movably in the mounting region 9 of the housing 1 in such a way that the subregion 15 and the freely movable second end 4 can only move parallel to the underlying surface. The arrangement of the extension part 25 in the mounting region 9 prevents movements away from the underlying surface. This prevents undesired damage to the contact 2 when the pressing block 17 is being removed.

Figure 5:
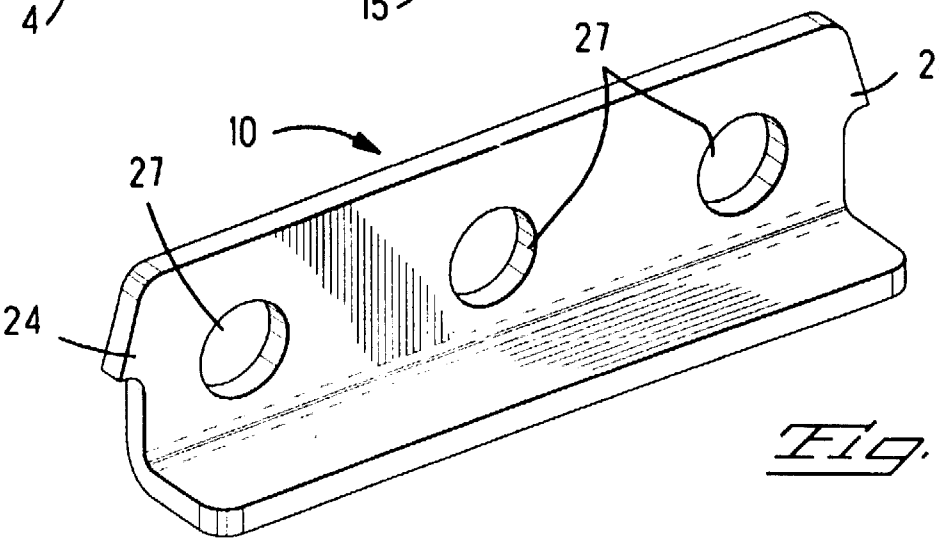
FIG. 5 shows a perspective view of the mounting aid from FIG. 1 and FIG. 3.

In FIG. 5, the mounting aid 10 is represented. Teeth 24 are provided for better fastening of the mounting aid 10 in the slot 21 in the mounting region 9 of the housing 1. Three circular apertures 27 can also be included so that the mounting aid 10 can also be encapsulated by the plastic of the housing 1 during the production of the connector. The mounting aid 10 may also have a greater length than is shown in FIG. 5. It is also possible for the mounting aid 10 to be used in the production of the connector as an endless tape on a carrier for a multiplicity of housings 1. This achieves the effect that the housings 1 are identically aligned and can be handled more easily in assembly.

Figure 6:
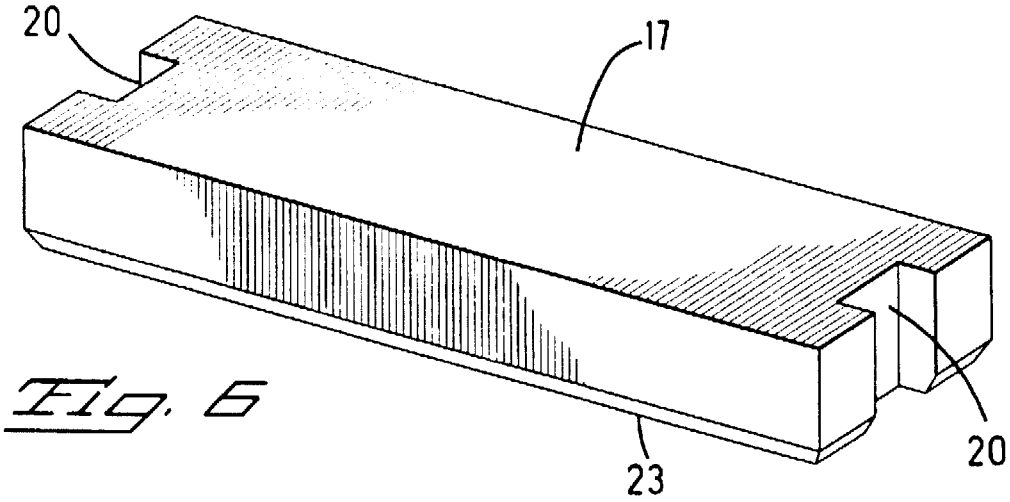
FIG. 6 shows a perspective view of the pressing block from FIG. 1 and FIG. 3.

In FIG. 6, the pressing block 17 is represented. The notches 20, the pressing block 17, as well as sloping flanks 23, which facilitate the introduction of the pressing block 17 in the opening 11 in the housing 1 can be seen.

Figure 7:
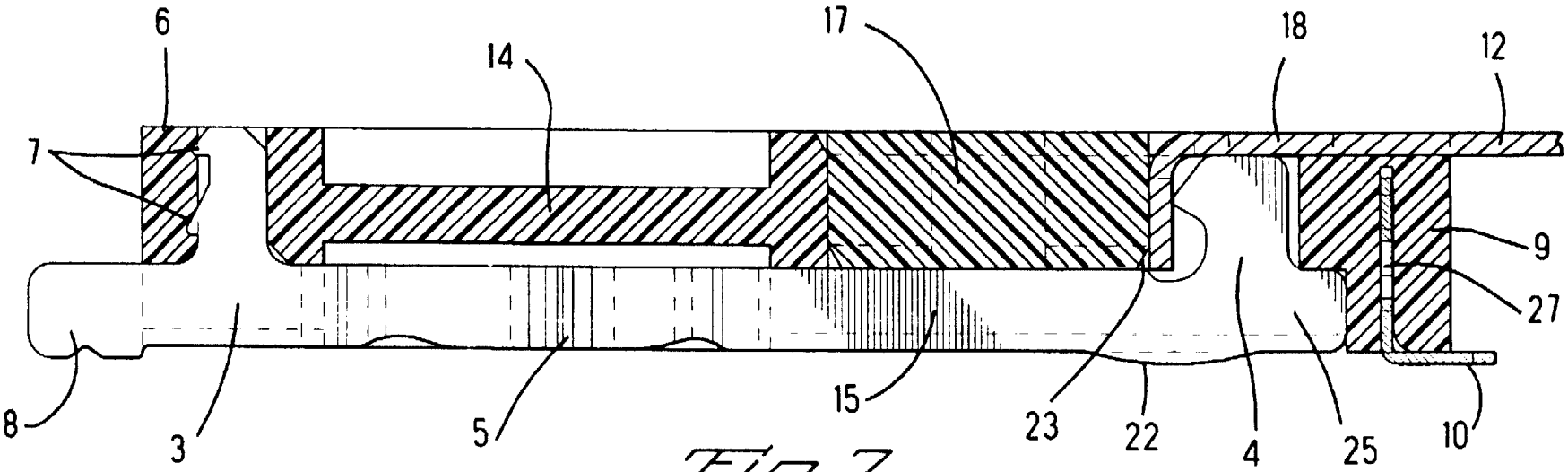
FIG. 7 shows a section through the connector for contacting from FIG. 1 in the assembled state, but without a flat foil conductor.

Represented in FIG. 7 is a cross-section through the assembled connector with a contact 2, with the fitted pressing block 17, engaged with the flat foil conductor 12. FIG. 7 shows the connector arrangement as it would be fastened on an underlying surface (not shown).

The double-T-shaped profile transitional region 14 is shown in cross-section. The mounting region 9 of the housing 1 does not have the same height as the fastening region 6. In the assembled state, the flat foil conductor 12 is located between the pressing block 17 and the freely movable second end 4 of the contact 2.

As a result of inserting pressing block 17 and the flat foil conductor 12 into the opening 11, the freely movable second end 4 is moved away from the fixed first end 3. This displacement is accommodated by the spring region 5 which further acts to maintain engagement with flat foil conductor 12. The double-T-shape of the transitional region 14 acts to provide structural integrity in light of the forces.

We claim:

1. An electrical connector comprising:

an insulative housing having a fastening end and a mounting end with an opening in an upper face thereof;

a contact extending longitudinally between a first end and a second end with a spring region therebetween where the second end is configured to engage a flat flexible conductor, the contact being received in the housing with the first end fixed in the fastening end and the second end being freely floatable in the mounting end and exposed in the opening; and a pressing block that is receivable perpendicularly in the opening relative the longitudinal direction of the contacts with the flat flexible conductor such that the second end of the contact is moved away from the first end so that the now stretched spring region is biasing the second end back towards the first end, whereby the flat flexible conductor would be held in electrical engagement with the contact.

2. The electrical connector of claim 1, wherein the spring section of the contact includes an arcuate bowed section.

3. The electrical connector of claim 2, wherein the connector includes a plurality of adjacently arranged contacts.

4. The electrical connector of claim 1, wherein when the spring region is stretched, the movable second end is is displaced further away from the fixed first end than before the pressing block is received in the opening.

5. The electrical connector of claim 3, wherein the plastic part has a cross-section with a double-T-shaped profile between the fastening region for the fixed first end and the opening for receiving the flat flexible conductor.

6. The electrical connector of claim 1, wherein the housing and the pressing block and the housing have a planar surface area on an upper side, whereby the surface can serve as an area for automatic processing machines.

7. The electrical connector of claim 1, wherein the housing has lugs to interact with a clearance in the flat foil conductor in such a way that the flat foil conductor will be inserted relieved of tension in the assembled state to provide strain relief.

8. The electrical connector of claim 1, wherein the contact includes an anchor post at the first end positioned in the housing for fixing the contact thereto and the second end includes a contact portion exposed in the opening, the pressing block acting to separate the contact portion from the anchor post upon insertion into the opening.

* * * * *